US005218936A

United States Patent [19]

Pritz et al.

[11] Patent Number: 5,218,936

[45] Date of Patent: Jun. 15, 1993

[54] IGNITION SYSTEM INCLUDING SPARK DISTRIBUTION CASSETTE AND IGNITION COIL

[75] Inventors: Steven E. Pritz, Westland; James P. Morris, Saline; Philip C. Chapekis, Ypsilanti, all of Mich.

[73] Assignee: Ford Motor Company, Dearborn, Mich.

[21] Appl. No.: 976,182

[22] Filed: Nov. 13, 1992

[51] Int. Cl.[5] ..... F02P 23/00; F02P 11/00; F02P 3/12

[52] U.S. Cl. ..... 123/143 C; 123/635; 123/647

[58] Field of Search ..... 123/143 C, 635, 647, 123/637, 655, 169 PA, 169 P, 169 PH

[56] References Cited

U.S. PATENT DOCUMENTS

| | | | |
|---|---|---|---|
| 1,335,933 | 4/1920 | Bohli | 123/143 C |
| 1,692,087 | 11/1928 | Matthew et al. | 123/143 C |
| 1,837,255 | 12/1931 | DuPont et al. | 123/143 C |
| 3,910,247 | 10/1975 | Hartig | 123/148 |
| 4,392,473 | 7/1983 | Tsutsui et al. | 123/635 |
| 4,463,744 | 8/1984 | Tanaka et al. | 123/643 |
| 4,617,907 | 10/1986 | Johansson et al. | 123/647 |
| 4,669,443 | 6/1987 | Oetting et al. | 123/647 |
| 4,671,248 | 6/1987 | Gillbrand et al. | 123/647 |
| 4,706,638 | 11/1987 | Johansson et al. | 123/647 |
| 4,706,639 | 11/1987 | Boyer et al. | 123/647 |
| 4,903,675 | 2/1990 | Huntzinger et al. | 123/647 |
| 5,109,828 | 5/1992 | Tagami et al. | 123/635 |
| 5,152,274 | 10/1992 | Urackawa | 123/635 |

*Primary Examiner*—Raymond A. Nelli
*Attorney, Agent, or Firm*—Roger L. May; Peter Abolins

[57] ABSTRACT

A method of making a unitary spark distribution cassette involves molding a cassette and placing electrically conductive lead frames within the cassette during molding. Electrically conductive sleeves for fitting over spark plugs are also provided on the cassette. An ignition system circuit using high voltage diodes in conjunction with an alternating flux ignition coil is placed in the cassette and connected to the lead frames and the sleeves to create a complete electrical circuit. The cassette is then filled with epoxy resin to encase the electrical components to form a unitary package.

5 Claims, 2 Drawing Sheets

IGNITION SYSTEM INCLUDING SPARK DISTRIBUTION CASSETTE AND IGNITION COIL

TECHNICAL FIELD

The present invention relates to vehicle ignition systems and more particularly relates to a spark distribution cassette for a distributorless ignition system which includes an integral ignition coil.

BACKGROUND ART

Vehicle ignition systems provide spark to engine cylinders in a controlled manner. Conventional vehicle ignition systems for internal combustion engines include spark plugs, a high voltage coil and a distributor which directs high voltage power through spark plug wires to the spark plugs. Recently, distributorless systems which rely upon microprocessor control have been introduced to more precisely control engine operation. In such systems, the distributor is eliminated and a microprocessor controls engine operation based upon data generated as a result of engine operation. Systems which utilize a distributor only require a single coil for four, six or eight cylinders in standard engine configurations. With a distributorless ignition system, one coil is generally used to develop a high voltage output for one or two spark plugs.

When servicing conventional ignition systems, it is necessary to analyze each of the components as well as each of the spark plug wires to determine which part or parts of the system require repair or replacement. This can be quite time consuming and requires skilled mechanics to perform the repair. Recently, modular groups of ignition parts have been proposed to connect an ignition coil or coils to several spark plugs simultaneously. Using a single unit to house the components of an ignition system provides advantages when servicing the ignition system. A mass produced part can be quickly removed and replaced. The replacement part can be fully checked for purposes of quality control resulting in improved reliability and customer service.

Providing a sealed spark distribution cassette including the coil improves durability. Housing the components in a single unit also protects the individual components from deterioration due to moisture or operation under harsh conditions.

The use of a single coil to provide four high voltage outputs for four separate cylinders is disclosed in U.S. Pat. No. 4,392,473 to Tsutsui et al. The Tsutsui patent discloses an ignition unit having high voltage terminals, high voltage diodes and ignition coils which are assembled together and potted in a synthetic resin. Spark plug wires are used to connect the output of the coil to the spark plugs. Lead wires are also used to connect the high voltage diodes associated with the coil taps to the spark plug wire terminals. The assembly of the Tsutsui ignition unit is complicated in that many connections to the diodes and coil must be soldered or otherwise connected together. The complex installation process required by the Tsutsui patent results in a system wherein significant costs are incurred for ignition part service.

A cassette-type ignition system is disclosed in U.S. Pat. No. 4,706,683 to Johansson et al which is designed to be mounted directly over the spark plugs of an internal combustion engine. The Johansson patent discloses a system wherein circuit boards are imbedded in the unit with epoxy and the ignition components of the system are included on the circuit boards. A single coil is provided for each engine cylinder. A capacitive discharge circuit is used to store charge and provide current to the spark plug. The use of circuit boards in the cassette assembly and capacitive discharge circuits result in increased cost of the cassette assembly due to increased manufacturing and component cost. Many soldered connections are required to complete the assembly of the Johansson unit.

Another example of a modular ignition system is disclosed in U.S. Pat. No. 4,706,639 to Boyer et al wherein the ignition module is mounted directly over the spark plugs of an internal combustion engine. The module disclosed in Boyer utilizes one coil for every two cylinders. Wires are used to connect the terminals to the ignition coil which necessitates soldering connections in the ignition module.

The present invention is directed to solving the problems confronted by the prior art ignition systems and processes for making modular ignition system components described above.

SUMMARY OF THE INVENTION

It is an object of the present invention to provide a compact, unitary ignition system which can be directly mounted over the spark plugs of an internal combustion engine and includes a single coil for providing a high ovltage spark to four different cylinders of an internal combustion engine. Another object of the invention is to provide an ignition system wherein no ignition wires are used to connect the coil to the spark plug socket, thereby minimizing soldered connections and intricate construction operations.

It is yet another object of the invention to provide a method of making a modular ignition system which can be easily automated and performed as a highly reliable automated system.

Accordingly, the present invention relates to an improved spark distribution cassette made according to a process wherein the cassette housing is molded with a recess large enough to hold the ignition coil and secondary distribution circuit components. Lead frames are molded into the cassette to provide conductive electrical paths between the ignition coil, high voltage diodes and the spark plug receptacles. The high voltage diodes are connected to the ignition coil by simply placing them inside the cassette where each diode is connected to an electrically conductive sleeve adapted to receive a spark plug. The cassette is then filled with a synthetic resin to encase the electrical components and form a unitary package. By forming a unitary assembly which can be directly mounted over spark plugs in an internal combustion engine, the ignition system is easily serviced by replacing the entire modular assembly. The elimination of high voltage ignition wires improves reliability and simplifies the diagnosis of engine operating problems, and also simplifies vehicle service procedures.

Because a single coil may be used to provide a high voltage spark for four cylinders, a reduction in the total number of coils needed for an engine can be achieved. By reducing the number of coils required it should be possible to reduce the cost and weight of the overall ignition system.

According to another aspect of the invention, lead frames are used instead of ignition wires to interconnect the coil to the spark plug receptacles. Lead frames also provide the primary electrical connection between the vehicle power system and the ignition primary coil.

Lead frames are rigid conductive members which are easily assembled into the cassette. The lead frames include preformed connectors to which the diodes, coil and spark plug receptacles are easily assembled. Lead frames also provide a reliable electrical connection thereby increase the reliability of the cassette during operation.

BEST MODE FOR CARRYING OUT THE INVENTION

Figure 1:
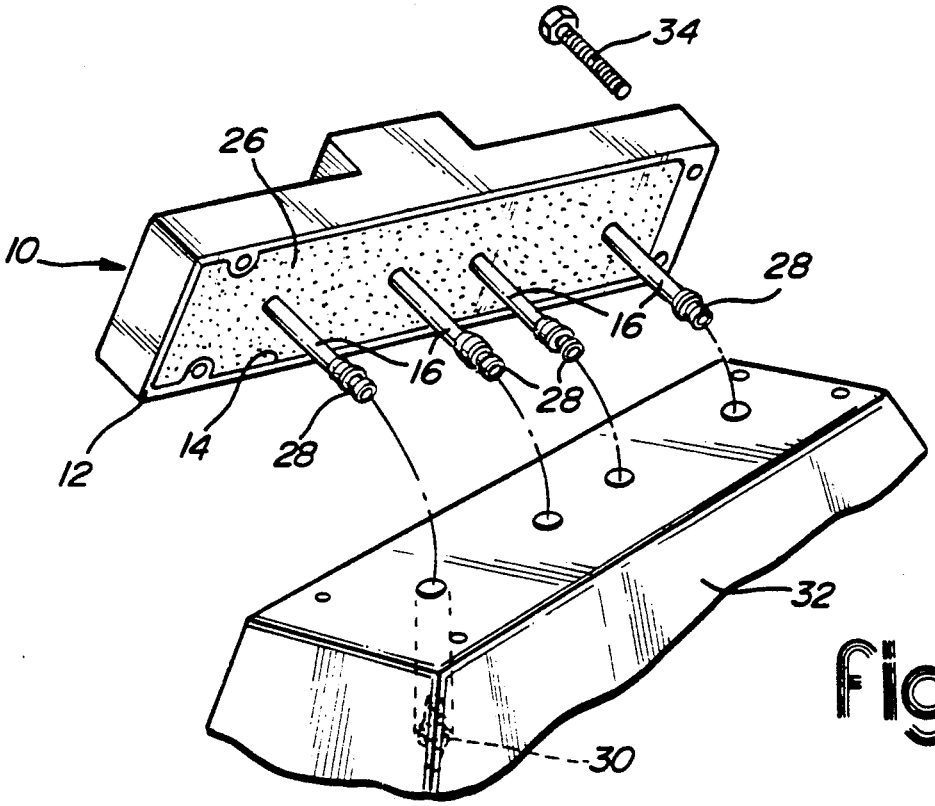
FIG. 1 is a fragmentary perspective view of an engine having an ignition system including the spark distribution cassette of the present invention.

Referring now to FIG. 1, there is illustrated a spark distribution cassette assembly, shown generally by reference numeral 10, for use with a spark-ignited internal combustion engine, shown generally by reference numeral 32. An electronic control unit, not specifically illustrated, manages operation of the engine, including control of the spark for the combustion process. As shown, the spark distribution assembly 10 includes a cassette shell 12 defining a recessed portion 14 or cavity. A plurality of sleeves 16 extend from the spark distribution cassette assembly 10.

Figure 2:
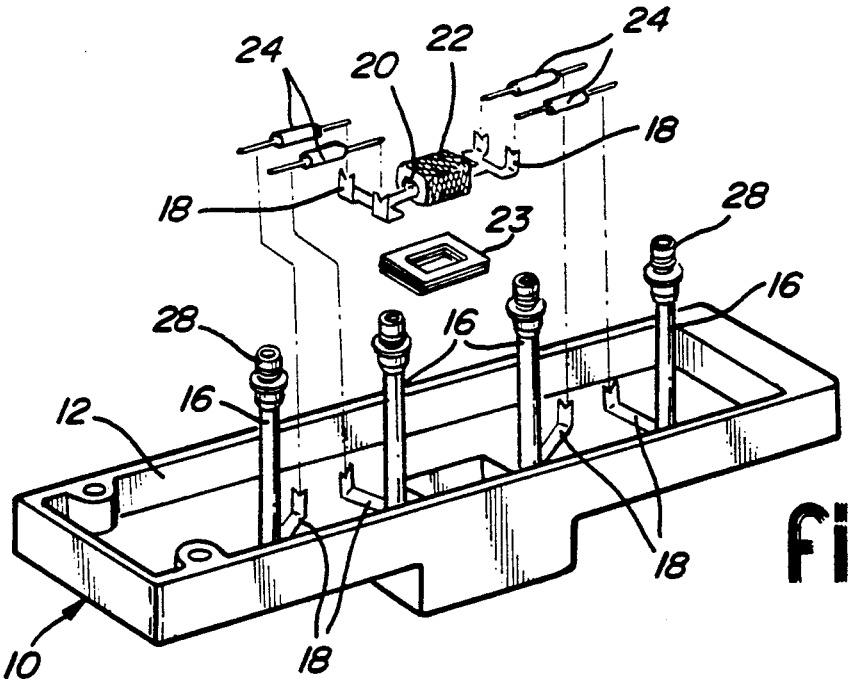
FIG. 2 is an exploded perspective view of the components of the spark distribution cassette and ignition coil of the present invention.
Figure 3:
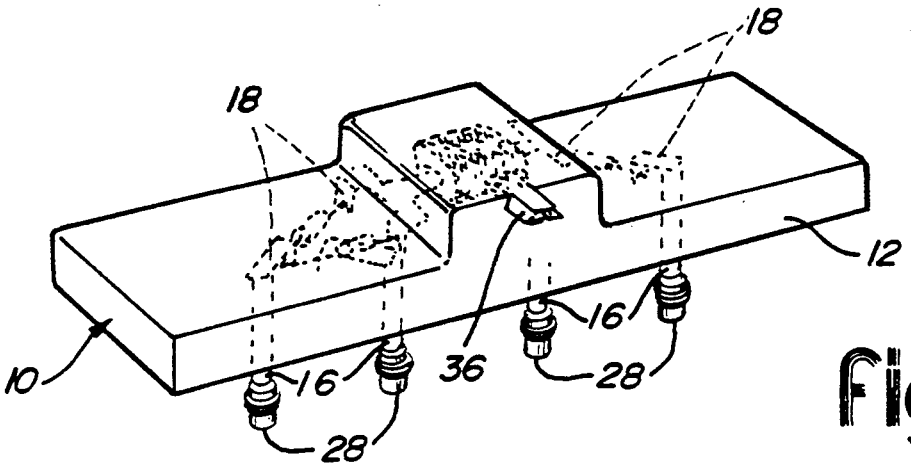
FIG. 3 is a perspective view of a spark distribution cassette and ignition coil of the present invention.

Referring now to FIGS. 2 and 3, the internal components of the spark distribution cassette assembly 10 will be described. A plurality of high voltage lead frames 18 are located within the cassette shell 12. A primary coil 20 and a secondary coil 22 are provided to create a high voltage output. A magnetic core 23 cooperates with the primary and secondary coils to intensify the magnetic fields associated therewith. Diodes 24 are placed in the high voltage lead frames 18.

As best shown in FIG. 1, an epoxy filler 26 fills the recessed portion 14 of the cassette shell 12, securing the components in the recessed portion 14 together. In the preferred embodiment, each sleeve 16 includes a socket 28 which is adapted to be placed over a spark plug 30 of an internal combustion engine 32. The spark distribution cassette assembly 10 is secured by fasteners 34, such as bolts, to the engine 32. Primary lead frames 36 are connected to a receptacle for a low voltage input to the spark distribution cassette assembly 10.

Figure 4A:
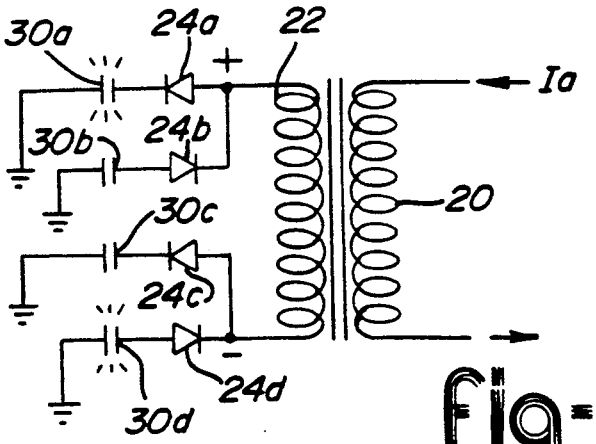
FIG. 4*a* is a partial schematic diagram of the ignition coil and spark distribution circuit with primary current flowing in a positive direction.

Referring now to FIG. 4*a*, a circuit diagram illustrating a first flux path of the ignition coil is shown wherein an input current $I_a$ is applied to the primary coil 20. The flux from the primary coil 20 induces a current in the secondary coil 22, setting up a high voltage output by the secondary coil 22. As shown, the direction of the input current $I_a$ flowing though the primary coil 20 sets up a positively biased input resulting in the corresponding positive and negative secondary coil voltage outputs.

With continuing reference to FIG. 4*a*, the diodes generally referred to above as 24 are more specifically shown as 24*a*, 24*b*, 24*c* and 24*d* to explain the alternative flux path circuitry. At the positive output of secondary coil 22, diode 24*a* is electrically connected in the circuit so as to conduct the high voltage output to spark plug 30*a*. Diode 24*b* blocks any output to spark plug 30*b*. At the negative output of the secondary coil 22, the diode 24*c* is electrically connected in the circuit so as to block any output to spark plug 30*c*, whereas diode 24*d* is electrically connected to provide a high voltage output to spark plug 30*d*.

Figure 4B:
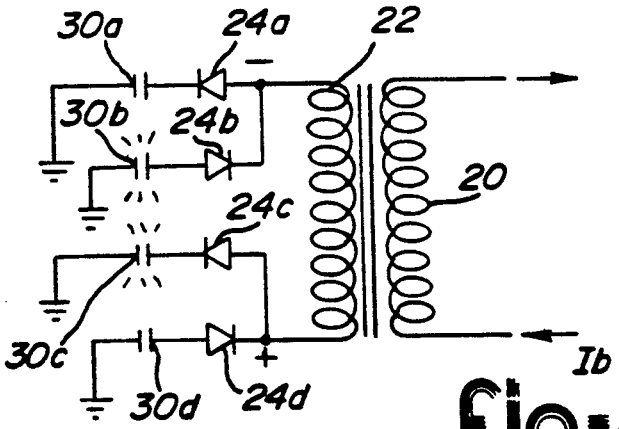
FIG. 4*b* is a partial schematic diagram of the ignition coil and spark distribution circuit with primary current flowing in a negative direction.

Referring now to FIG. 4*b*, a circuit diagram is shown for an alternative flux path wherein an input current $I_b$ is applied to primary coil 20. The flux-induced current in the secondary coil 22 sets up a high voltage output having a polarity opposite that shown in FIG. 4*a*. At the negative output, diode 24*a* is electrically connected in the circuit so as to prevent energization of spark plug 30*a*. Spark plug 30*b*, however, is energized by the high voltage spark conducted through diode 24*b*. At the positive side of the secondary coil, diode 24*c* conducts, allowing a high voltage spark to energize spark plug 30*c*, whereas diode 24*d* blocks voltage from spark plug 30*d*.

The method of the present invention will be described in detail with reference to FIGS. 1, 2 and 3. The first step in the method is to mold the cassette shell 12. The cassette shell is preferably molded to include a plurality of preformed electrically conductive lead frames 18 disposed within the recessed portion. Primary and secondary coils 20 and 22, surrounded by a magnetic core 23, are positioned in the recessed portion proximate to each other such that current flowing in the primary coil induces a current in the secondary coil. The primary and secondary coils are then electrically connected to associated lead frames. The secondary lead frames are connected to sleeves 16 which extend from the cassette shell 12 into the internal combustion engine. Each sleeve 16 includes a socket 28 which receives one end of a spark plug. A plurality of diodes are connected to the secondary lead frame members without soldering. The lead frame members preferably have lead frames adapted to receive the diode leads securely. The cavity is then filled with a potting compound, such as an epoxy resin, which seals and secures the component parts within the cassette shell. This results in a spark distribution cassette having minimal soldering connections, since there are no ignition wires extending between the coils and the spark plug sockets.

It will be readily appreciated by one of ordinary skill in the art that the above description of a preferred embodiment of the invention is presented by way of illustration and not by way of limitation. The scope of the present invention should be interpreted in light of the following claims.

We claim:

1. A method of making a spark distribution cassette for mounting on an engine, the method comprising the steps of:

molding a cassette shell, the cassette shell having a recessed portion and being molded about at least one sleeve having an end portion adapted to receive a spark plug;

securing at least two lead frames in the cassette during the molding step;

placing a diode in each of the lead frames;

placing a primary coil and a secondary coil in the recessed portion;

connecting the primary coil to one of the at least two primary lead frames;

connecting the secondary coil, the at least one diode and the sleeve to the other of the at least two plurality of secondary lead frames; and filling the recessed portion with resin so as to encase the primary coil, the secondary coil, the diodes and the lead frames, thereby forming a unitary package without ignition wires extending between the secondary coil and the spark plug.

2. The method of making a spark distribution cassette of claim 1 wherein the step of placing a primary coil and a secondary coil in the recessed portion comprises the steps of:

forming an outer core; and placing the primary coil and the secondary coil in the outer core.

3. The method of making a spark distribution cassette of claim 1 wherein the resin used in said filling step is epoxy.

4. A spark distribution cassette for mounting over a plurality of spark plugs on an engine, the spark distribution cassette made by a process comprising the steps of:

molding a cassette shell, the cassette shell having a recessed portion and being molded about a plurality of sleeves each having an end adapted to receive a spark plug;

securing primary and secondary lead frames in said cassette shell during the molding step;

positioning a primary coil in said recessed portion in electrical communication with said primary lead frame;

positioning a plurality of diodes and a secondary coil in said recessed portion in electrical communication with said secondary lead frame;

electrically connecting each of the sleeves to the secondary lead frame, the diodes selectively conducting current from the secondary coil through lead frame to the sleeves; and filling the recessed portion of the cassette shell with resin to encase the primary coil, the secondary coil, the diodes and the primary and secondary lead frames, thereby forming a unitary package without ignition wires extending between the secondary coil and the spark plug.

5. A spark distribution cassette for a spark-ignited internal combustion engine, the engine being controlled by an electronic control unit, the spark distribution cassette comprising:

a cassette shell defining a recess;

a primary coil disposed within the recess;

a secondary coil disposed adjacent the primary coil;

a core positioned about the primary and secondary coils:

a primary lead frame electrically connected to the primary coil without soldering and a plug receptacle for receiving controlled current pulses from the electronic control unit;

a plurality of secondary lead frames each electrically connected to the secondary coil;

a plurality of diodes electrically connected to said secondary lead frames; and a plurality of sleeves each having a socket for receiving an associated spark plug, said sleeves being electrically connected to said secondary lead frames, wherein controlled current pulses from said electronic control unit are applied to the primary coil, the secondary coil generating high voltage signals based on the current pulses, the high voltage signals being conducted by the secondary lead frames through the diodes and the sleeves to the associated spark plugs without ignition wires.

* * * * *